United States Patent [19]

Case et al.

[11] 4,417,425

[45] Nov. 29, 1983

[54] APPARATUS FOR ERECTING CONCRETE WALL PANELS

[75] Inventors: James E. Case; Richard L. Ruppert, both of Sparks; Lindley Manning, Reno, all of Nev.

[73] Assignee: Dayton Superior Corporation, Miamisburg, Ohio

[21] Appl. No.: 767,880

[22] Filed: Feb. 11, 1977

[51] Int. Cl.[3] ..... E04D 15/00

[52] U.S. Cl. ..... 52/125.5; 294/86 R; 294/89

[58] Field of Search ..... 52/98–100, 52/125, 127, 704, 707, 711; 294/86 R, 89; 403/326, 327, 330

[56] References Cited

U.S. PATENT DOCUMENTS 4,068,879 1/1978 Torbet ..... 52/707 X

*Primary Examiner*—James G. Smith

*Attorney, Agent, or Firm*—Gerlach & O'Brien

[57] ABSTRACT

A pickup device has a trunion plate that is placed across an opening formed by a tubular insert in a horizontal concrete slab or panel. A housing extends through a hole in the trunnion plate into the insert and defines an internal cavity disposed inwardly of the insert. A bore communicates an end of the housing outside the panel with the housing cavity. An axially movable actuator rod or plunger is disposed in the bore and includes a head disposed in the cavity and formed of contiguous cylindrical and conical portions. A plurality of lugs are movably mounted in housing cutouts that extend radially outward of the cavity and such lugs have sides facing the plunger head which are, respectively, parallel to the cylindrical and the conical portions of the plunger head for cooperation therewith so that the lugs are moved radially outward of the housing by the cooperating conical portion of the head and the angularly inclined lug sides. The lugs are locked in their extended position by the interengagement of the cylindrical head portion and corresponding straight lug sides. Pawls cooperate with the lugs and the plunger to retract the former in response to a pawl retracting motion of the plunger.

25 Claims, 9 Drawing Figures

APPARATUS FOR ERECTING CONCRETE WALL PANELS

BACKGROUND OF THE INVENTION

So-called concrete tilt-up building panels or slabs are increasingly used in the construction industry, primarily for commercial and industrial buildings. In such constructions concrete panels are formed on the floor of the building or on an adjoining level ground surface by pouring the panels in their horizontal position. After the concrete has hardened, the panels are lifted into a vertical or upright position and interconnected to form the walls of a building.

Due to their large weight special provisions must be made to pick up the panels with a crane or the like without damaging the panels, without permitting the panels to swing freely which would endanger life and property, and, most importantly, without permitting any of the panels to drop during the erecting process. In the past a variety of ways and means for accomplishing this task have been proposed or attempted. The following U.S. Pat. Nos. are exemplary of such attempts: 2,794,336; 3,431,012; 3,456;547; 3,652,118; and 3,705,469.

A common characteristic of these patents is that each of them discloses the idea of embedding in the concrete panel or slab a suitably formed insert that defines an aperture or opening into which a mating pickup device can be inserted as a preliminary to a panel-hoisting operation. In one prior art attempt, the insert defines an interiorly threaded surface, such as is disclosed in U.S. Pat. Nos. 3,456,547 or 2,794,336, into which a correspondingly threaded shaft of the pickup device can be inserted. In other instances, as shown in U.S. Pat. Nos. 3,431,012 or 3,705,469 for example, crossbars or the like traverse the openings in the panel and the pickup device has correspondingly shaped members for engaging the crossbars and thereby locking the device to the insert.

Prior art concrete panel pickup systems (which include the concrete embedded insert and the pickup device that is removably attached to the insert) have various relative advantages and disadvantages. There are some which have proved unreliable in the field and at times they have resulted in panels dropping from the crane. Such events, of course, can be disastrous if the dropping panel strikes a person; in addition, the panel is normally cracked and lost. Other prior art pickup systems have proved relatively safe. However, in operation they proved to be less than fully satisfactory.

For example, panel pickup systems employing threaded inserts normally have the insert in the form of a tightly wound spring into which a threaded shaft must be inserted. If the shaft is threaded into the insert, the task is time-consuming and adds to the overall cost of erecting a building wall. If the shaft is a split shaft (such as is disclosed in U.S. Pat. No. 3,456,547) in which two shaft halves are collapsed, then axially inserted into the insert, and thereafter spread apart with a wedge, even slight foreign matter on the interior insert surface, such, for example, as hardened concrete particles, can prevent proper operation of the device.

If this is the case a workman must first clean the rather inaccessible insert interior before the insert can be applied. In addition to requiring costly labor to clean the insert and mount the pickup device, auxiliary equipment such as the pickup crane as well as personnel such as the crane operator and assisting workmen remains idle.

Another serious shortcoming of prior art panel pickup systems is the manner in which the pickup devices are removed from the panel-embedded inserts. Frequently, it is necessary for a workman to place a ladder against the upright panel, climb the ladder to the height of the pickup devices, and then release the devices, manually or with the help of such tools as hammers, screwdrivers, pliers and the like. Parts that can become wedged make this task even more difficult.

Once the pickup device is released there are normally one or more loose parts which must be saved for the application of the pickup device to the next insert. This alone is tedious. Moreover, the loose parts can drop and injure bystanders and become damaged. In the rough surroundings of general construction sites such loose parts are dangerous to persons and the parts themselves are in constant danger of being lost or damaged hence requiring replacement.

Since the discussed difficulties of attaching the pickup device are rather common with prior art systems and since the erection of large buildings may require erection of hundreds of tilt-up panels, the cost added by unsatisfactorily functioning pickup systems can be substantial.

SUMMARY OF THE INVENTION

The present invention provides a tilt-up panel pickup system which overcomes the above-discussed shortcomings of prior art systems. It is of a rugged and relatively low cost construction and, more importantly, it requires virtually no maintenance, yet it functions satisfactorily and safely time after time. The pickup device of the system can be inserted almost instataneously and it is withdrawn by simply pulling a spring biased plunger. Both the insertion and the withdrawal of the pickup device into the concrete embedded insert require no more than an axial movement of the pickup device. There is no need laboriously to thread one member or part into the other, to hold together, align and insert loose parts, or to pry them apart, all of which require a great deal of skill, and upon the withdrawal of the device from the erected panel, there are no loose components of the pickup device which may injure workmen, or which may become lost, soiled or damaged from falling to the ground from substantial heights. Thus, the tilt-up panel pickup system of the present invention greatly improves both the reliability and operating characteristics as compared to prior art pickup systems while it affords significant economies which help reduce the over-all cost of constructing the walls of a concrete building.

In general terms, a pickup system constructed in accordance with the present invention comprises a tubular insert that is embedded in the concrete after the latter is poured and then hardened for panel or slab-forming purposes. An inner end face of the insert defines an inwardly facing annular shoulder or abutment and communicates with an enlarged cavity which is formed in the concrete panel by way of a thin plastic mold that has a larger diameter than the inside diameter of the tubular insert and includes an annular, radially inwardly extending lip in contact with the inwardly facing end face of the tubular insert. To center the mold with respect to the insert during pouring of the concrete the lip is preferably attached to a second, tubular plastic section that is integrally constructed with the lip and that extends through the insert to the exterior thereof. After the concrete has hardened the outwardly protruding tubular plastic section can be removed by providing a properly shaped score mark so that the section can be readily broken off, leaving a clean internal econcrete cavity which is defined by the remaining large diameter mold section.

The pickup device itself normally has a generally cylindrical housing assembly which is dimensioned snugly to extend into the insert. The assembly includes a housing or housing proper that has first and second ends and an internal cavity proximate the first end. An elongated bore extends from the cavity to the second end and a plurality of cutouts extend generally radially outward of the cavity in a direction perpendicular to the bore.

An actuator rod or plunger is axially slidable in the bore and has a first end within the cavity and a second end which protrudes past the housing and is exposed. The first plunger end is defined by a generally conical portion and a contiguous, generally cylindrical portion both of which are disposed in each cutout and can be moved therein between a first or retracted position in which it is disposed wholly within the housing and a second or extended position in which a portion of it protrudes past the housing so that the protruding lug portion can engage the inwardly facing annular shoulder of the insert when the pickup device is placed into the insert.

The end of each lug that faces the axis of or is adjacent to the plunger has a straight surface section that is parallel to the plunger axis and the cylindrical portion of the first plunger end and an inclined surface section that is generally parallel to the conical portion of said first plunger end. The two lug surface sections are arranged so that they are engaged by the corresponding conical and cylindrical plunger portions when the plunger is axially moved in the direction in which the conical portion faces to correspondingly move the lugs in directions perpendicular to the plunger movement and outward of the cavity and the cutouts. Means disposed interiorly of the cavity is also provided for moving the lugs back into the cavity in response to a corresponding movement of the plunger in a direction opposite to the direction in which the conical portion faces.

This pickup device thus requires no more than a linear, axial insertion of the housing into the tubular, panel-embedded insert and thereafter an axial, e.g., an axially inward, movement of the plunger to extend the lugs into the enlarged panel cavity and cause their outer ends to engage the inwardly facing, annular shoulder at the inner end of the tubular insert. A particular advantage of the pickup device of the present invention is the fact that the plunger cannot be moved or slid axially into the housing unless all of the lugs are extended; thus it is not possible for one or more of the lugs to remain retracted and thereby present a serious safety hazard. In addition, once the lugs have been fully extended they are engaged by the cylindrical portion of the first or inner end of the plunger which acts as a positive mechanical lock. So long as the plunger remains in this position it is impossible for any of the lugs to be retracted through rough handling, shock or vibration, wedging or other normally encountered movements and forces. Without such a safety feature the accidental withdrawal of a lug into the housing interior could lead to the disengagement of the pickup device and a resulting dropping of the panel as sometimes occurred with prior art devices.

Once the panel has been erected into an upright position the present invention enables the almost instantaneous release of the pickup device from its respective panel insert. This is done by providing a release tool in the form of an elongated generally L-shaped handle which includes an upwardly open fork adjacent to its short leg. The long handle leg is of a sufficient length so that a workman positioned on the ground adjacent to the panel can reach the pickup device with the fork.

The plunger in the housing of the pickup device is provided at its second or outer end with an exposed head which is engageable with the fork of the release tool and the fork is oriented perpendicular to the plunger axis while the handle is shaped so that it lies in a plane parallel to the plunger axis. To release the device the workman simply uses the joinder or junction between the long and short legs of the L-shaped handle of the release tool as a fulcrum point by resting it against the erected panel. He then pushes the lower end of the handle towards the panel, thereby pulling the plunger outwards with respect to the housing thus retracting the lugs into the housing interior. The continued pushing on the lower handle end slides the housing out of the panel insert.

Thus, the release of the pickup device can be accomplished without the need for positioning a ladder against the just erected panel, climbing up the ladder and tediously dismantling the pickup device. Moreover, the release of the pickup device in accordance with the present invention does not separate parts so that they are capable of dropping to the ground and injuring a person or becoming damaged.

It is therefore apparent that the present invention represents a significant improvement to tilt-up panel pickup systems both in terms of their reliability and in terms of their operating efficiency. The pickup device of the particular system constituting the present invention is almost instantaneously applied and released and its rugged construction requires almost no maintenance. The construction of the insert in accordance with the invention forms a clean opening in the panel which is readily accessible normally via a large, e.g., 2 to 2½ inch diameter, hole. In the unlikely event that the internal concrete cavity must be cleaned, as when a foreign object or particle drops into it, this is readily accomplished through the large diameter access hole which is provided by the insert. In addition, the insert which is a consumable item, is constructed of the most simple, readily assembled components so that its cost is also low, in most instances, lower than prior art inserts which frequently operate in an unsatisfactory manner.

DESCRIPTION OF THE PREFERRED EMBODIMENTS

Figure 1:
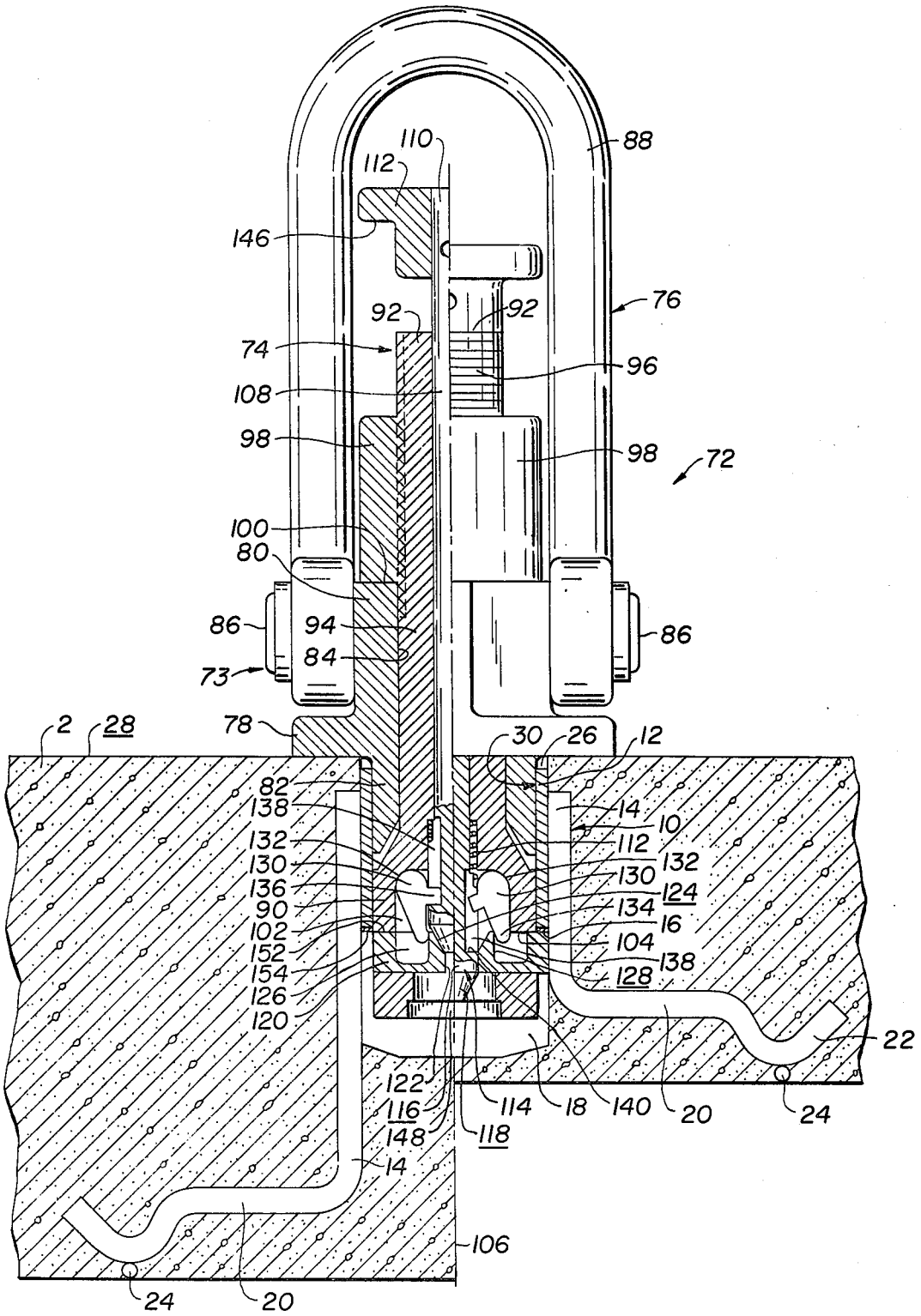
FIG. 1 is a side view, partially in section and partially in elevation, of a concrete panel (shown as having two different thicknesses for illustrative purposes only) fitted with a tilt-up panel pickup system constructed in accordance with the present invention.

Referring first to FIGS. 1 and 5–7 of the drawings, a concrete building panel 2 is illustrated in its upright or vertical position (see FIG. 5) as forming part of a side wall 4 of a building 6 resting on a ground surface 8. The panel itself is prefabricated in a horizontal position, e.g., on the ground adjoining the building wall, by pouring fresh concrete in an open concrete form (not shown). To enable the erection of the panel after the concrete has set, a set of anchor or pickup inserts 10 is embedded in the concrete at strategic locations as determined in a conventional manner.

In a preferred embodiment of the invention each insert is constructed of a relatively short section 12 of conventional steel pipe, such pipe section having a diameter of at least 2-2½ inches and a length about equal to its diameter. Preferably four generally L-shaped legs are welded or otherwise firmly secured to the outer periphery of the pipe section 12 and they extend past the inner end face 16 of the pipe section, such end face being directed towards an internal, large diameter, concrete cavity 18 in the panel 2 and forming an annular shoulder or abutment. As shown in FIG. 1, the L-shaped legs embody comparatively short inner portions which are welded to the outer periphery of the pipe section 12, and longer outwardly or radially extending portions 20. A curved outer end part 22 of each outwardly or radially extending leg portion 20 is fitted with a short, preferably cylindrical rod 24 for concrete-interlocking purposes. The L-shaped legs and the pipe section 12 are dimensioned so that an outwardly (and upwardly) facing end 26 of said pipe section is disposed slightly beneath the upper side 28 of the finished concrete panel 2. For the differing panel thicknesses as illustrated in FIG. 1 the L-shaped legs have correspondingly differing vertical lengths of their inner portions so that in each instance the outwardly facing end 26 of the pipe section is proximate but below the panel side 28.

Once the concrete has hardened the insert 10 is firmly embedded in the panel 2 and defines an outwardly opening hole 30 that communicates with the internal concrete cavity 18.

For reasons which will become more apparent hereinafter, the concrete cavity 18 in the panel 2 requires a diameter that is larger than the inner diameter of the pipe section 12 so that the inwardly facing end 16 of the pipe section remains accessible. To form a cavity with a larger diameter than the inside diameter of the pipe section 12, the present invention provides a generally cylindrical, hollow mold 32 which is defined by a first or inner tubular section 34 that has an inner diameter at least as large as the outer diameter of the pipe section 12, a second or outer tubular section 36 that has an outer diameter about equal to the inner diameter of said pipe section 12, and a generally horizontally oriented, annular or ring-shaped lip 38 interconnecting the two tubular sections. The mold further includes a circular bottom wall or plate 40 which is integrally molded with the free or lower end of the first tubular section 34 and a top wall or cover plate 42 which is integrally molded with the free or upper end of the second tubular section 36. A pull tab 44 extends upwards or outwards from the cover plate 42. Lastly, the mold 32 includes a circular score mark or cut 46 that is aligned with the outer diameter of the second tubular section 36 and extends into the inner edge portion of the annular lip 38 in order to form a weakened cross-section at that point to the end that after hardening of the concrete for the panel 2 the second mold section 36 may be removed from the first mold section 32 by pulling on the tab 44.

Before the concrete panel 2 is poured, the mold 32 is attached to the insert 10 by slidably inserting the second tubular mold section 36 into the pipe section 12 until the annular lip abuts against the end face 16. It will be observed that the first tubular section 34 of the mold 32 prevents shifting of the second tubular section 34 while the concrete is poured and hardens and keeps said second section aligned with the pipe section 12 even though the annular lip 38 and the mating end face of the pipe section 12 are flat and otherwise slidable with respect to each other. In addition, the second tubular mold section 36 together with its cover plate 42 prevents fresh concrete or other foreign objects from accidentally entering the pipe section and contaminating it, thus eliminating cleaning of the interior of the pipe section 12 before the insert is ready for use.

After the concrete has hardened a workman grasps the pull tab 44 (which may be provided with suitable finger holes, not shown) and pulls the tab away from the insert 10. This causes a breakage of the mold along the reduced cross-section which is defined by the circular score mark 46 and leaves a clean and fully accessible, large diameter inner concrete cavity 18 for use as described below. After the tab pulling operation, the second mold section 36 is removed entirely from the insert 10 and the panel 2 while the first mold section 34 remains permanently in the panel and defines the cavity 18 as shown in FIG. 1.

The mold 32 may be constructed of any suitable material. Preferably, however, it is constructed of a crushable material such as plastic which can be economically molded. The annular lip 38 of the mold 32 forms a "crushable" material layer on the inwardly facing end 16 of the pipe section 12 for purposes more fully described hereinafter. The thickness of this crushable layer is preferably selected as described below.

Figure 6:
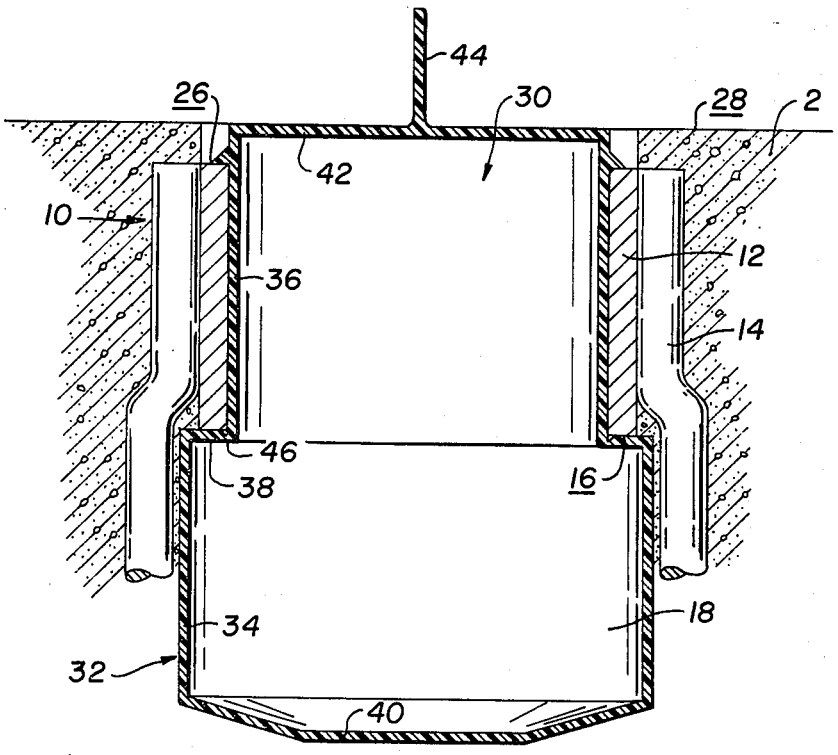
FIG. 6 is an enlarged sectional view of part of an insert embedded in a poured concrete panel and of a mold applied to the insert for forming an enlarged internal cavity in the concrete panel.
Figure 8:
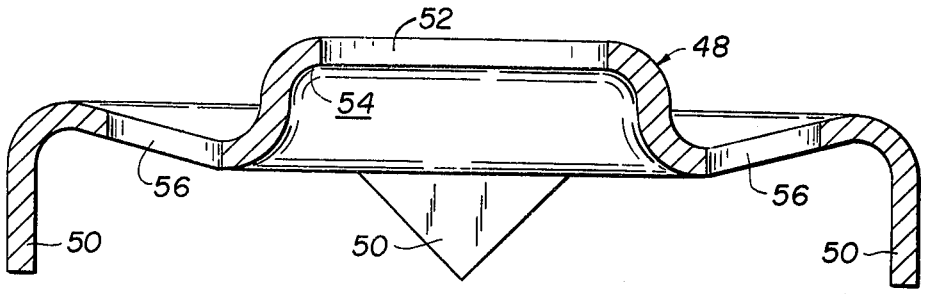
FIG. 8 is a transverse sectional view of another panel insert constructed in accordance with another embodiment of the invention.
Figure 9:
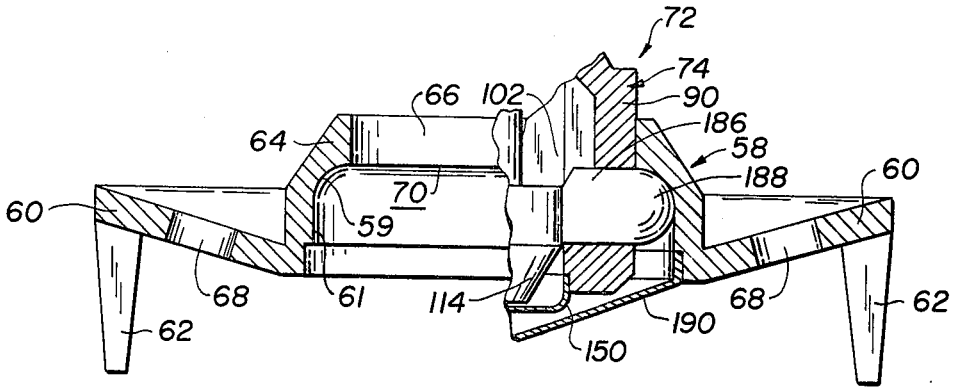
FIG. 9 is a transverse sectional view similar to FIG. 8 but illustrating yet another construction of the panel insert in accordance with a further embodiment of the invention.

Referring now briefly to FIGS. 8 and 9, insert constructions which are slightly different from that shown in FIGS. 1 and 6 and discussed above are illustrated. In the embodiment of FIG. 8 an insert 48 is fabricated from a heavy, e.g., ¼ inch thick, steel plate of an initially substantially square configuration and the corners of the plate are bent down to form four spaced-apart, substantially vertical legs 50. A center portion of the plate is raised and includes a circular cutout 52 which defines an opening corresponding to the inner diameter of the pipe section 12 which is illustrated in FIGS. 1 and 6. The plate is dimensioned so that the distance between the lower ends of the legs 50 and the top of the raised center portion through which the cutout 52 is punched is slightly less than the thickness of the concrete panel (not shown in FIGS. 8 and 9). The above discussed plastic mold 32 may be inserted through the cutout 52 in the center portion of the plate and then manipulated so that its annular lip 38 between the sections 34 and 36 thereof abuts against the underside 54 of that portion of the plate which surrounds the cutout in order to form the concrete cavity 18 in the concrete panel 2 (not shown in FIGS. 8 and 9). In addition, the insert 48 of FIG. 8 includes a plurality of holes 56 in the portion of the plate between the center and the legs in order to improve anchoring of the insert in the concrete.

FIG. 9 of the drawings shows an insert 58 that is cast of a suitable material such as steel. It has a slightly downwardly dished annular section 60 from which four elongated legs 62 protrude downwardly. A frusto-conical center part 64 projects upwardly from the inner marginal portion of the annular section 60 of the insert 58 and defines a circular opening or aperture 66 which again corresponds to the inner diameter of the pipe section 12 of the insert 10 in FIGS. 1 and 6. The annular section 60 also includes a plurality of holes 68 to facilitate anchoring of the insert 58 in the concrete. Before the concrete is poured around the insert 58 a mold (not shown) such as the one shown in FIG. 6 is inserted through the aperture 66 and manipulated so that its annular lip abuts against the underside 70 of the center cone 64 in order to form the internal concrete cavity 18.

Figure 2:
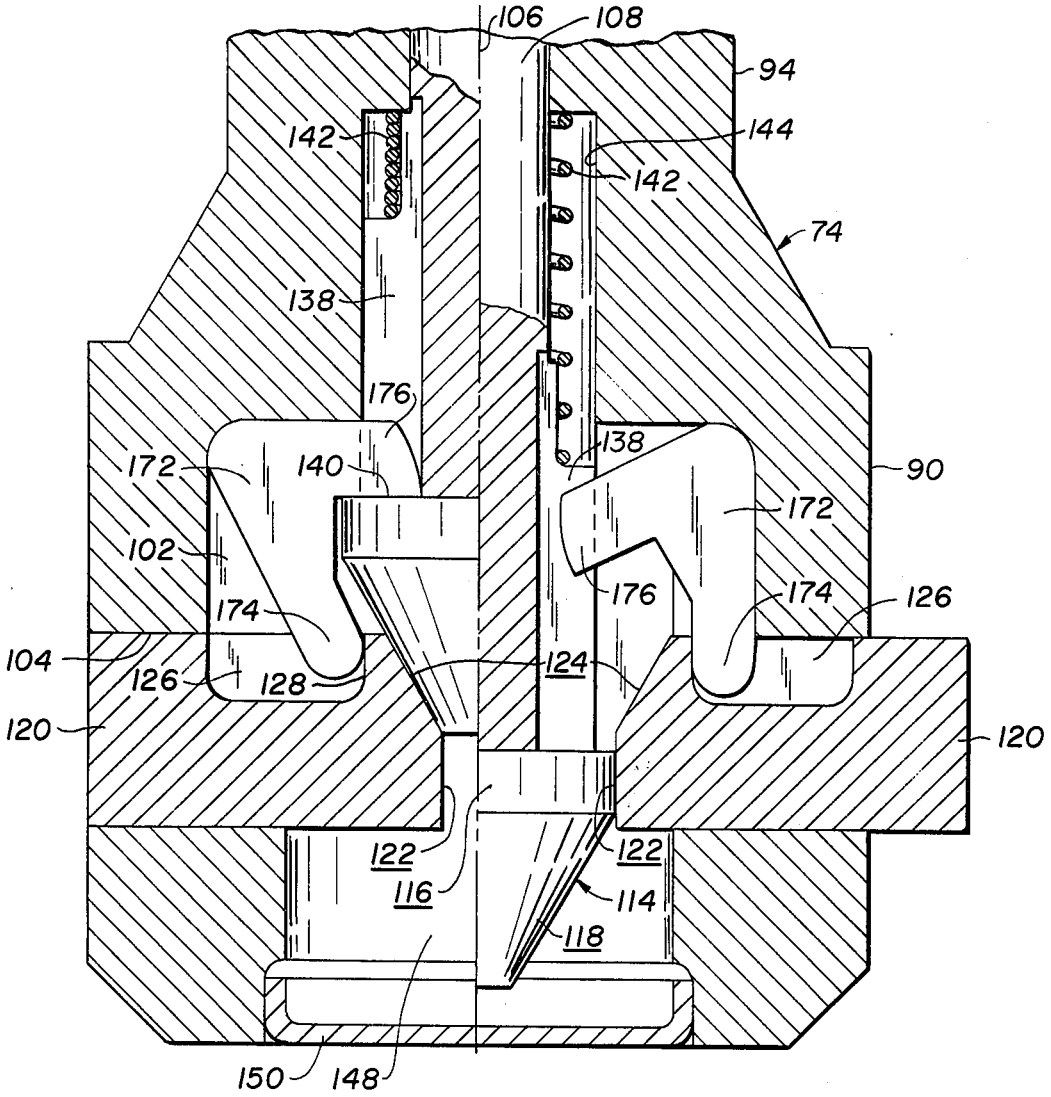
FIG. 2 is an enlarged, fragmentary, side elevational view partially in section and partially in elevation, of the inner portion of a pickup device that is adapted to extend into an associated insert in a concrete panel, such view illustrating the device in two operating positions, and further showing a different embodiment of the present invention.

Referring now to FIGS. 1 and 2, the present invention provides a pickup device 72 which serves as an interconnection between the panel-embedded insert 10, 48 or 58 and hoisting machinery such as a crane (not shown). Generally speaking, the pickup device comprises an elongated, generally cylindrical housing assembly 73 that can be inserted into the insert and securely locked thereto and a U-shaped bail 76 for attaching the housing to the crane. Turning to the housing assembly 73 first, it comprises a normally rectangular plate 78 which has a sufficient width or area so that it can be positioned across the aforementioned insert hole 30, and includes a first, outwardly extending, tubular flange 80 and a second, inwardly extending collar 82 which is axially aligned with the flange. An elongated bore 84 extends from the collar 82 through the plate 78 and the tubular flange 80. The outside diameter of the collar 82 is slightly less than the inside diameter of the pipe section 12 so that the former can snugly fit into the latter thereby to align the plate 78 and the bore 84 with the insert. The collar 82 extends to no more than about one-half the length of the pipe section 12.

Two aligned trunnions 86 are spaced outwards from the plate 78 and are connected to and project in opposite directions from the tubular flange 80. The free ends of the side legs of the bail 76 are pivotally attached to the trunnions 86. In use the bail is engaged with the hook (not shown) of the crane.

The housing assembly 73 also comprises an elongated generally cylindrical housing or housing proper 74 which extends completely and slidably through the bore 84 and has a first enlarged end 90 which is adapted to be disposed inside the pipe section 12 of the insert 10, a second or opposite end 92 which is adapted to be disposed outside of the insert 10 and the panel 2, and an intermediate section 94 which extends between the two ends 90 and 92 and has a diameter slightly smaller than the diameter of the bore 84 so that the housing 74 can slide along the bore. A portion of the intermediate section 94 adjacent to the second end 92 of the housing 74 is provided with an external screw thread 96 which is engaged by a knurled adjustment nut 98. The thread is sufficiently long so that the nut can be run down along the thread until it engages an end face 100 of the tubular flange 80. When the nut 98 is tightened against the end face 100, the housing 74 is in fixed relation with the plate 78, the flange 80 and the collar 82, and such parts thus make the housing assembly 73 as a whole of unitary character.

An enlarged internal cavity 102 is formed in the enlarged housing end 90. This cavity communicates with the exterior of the housing via four, equally spaced, radially extending coplanar cutouts 104. The latter are preferably of square cross-section, and are disposed at right angles to the longitudinal axis 106 of the housing 74. A relatively narrow, elongated cylindrical bore extends in the housing 74 from the cavity 102 to and through the second housing end 92.

Disposed within the bore is an axially movable actuator rod or plunger 108 an outer end 110 of which is fitted with a pull head or cap 112 and this is pinned or otherwise fixedly attached to the plunger. The other or inner end of the plunger has an actuating head 114 which consists of a cylindrical head portion 116 followed by a contiguous conical head portion 118 which faces towards the central portion of the interior concrete cavity 18.

An elongated lug 120 is translatably or slidably disposed in each cutout 104, that is, it can be moved inward so that it is wholly disposed within its cutout 104 and also the cavity 102 (as is shown in the left-hand half of FIG. 1) or it can be moved outward (as is shown in the right-hand half of FIG. 1) so that its outer end portion protrudes past the exterior of the enlarged housing end 90. The lugs 120 have a cross-section which is complementary to that of the cut-outs 104. They extend lengthwise of said cut-outs and have their inner ends defined by a first surface section 122 which is parallel to the housing axis 106 and also to the cylindrical head portion 116 of the plunger 108, and a contiguous obliquely extending surface section 124 which is angularly inclined relatively to said housing axis 106 by an angle (such as 30°) equal to the angle of conical head portion 118 of the plunger 108. The oblique surface section 124 of each lug faces in the opposite direction from the conical head portion 116 and the sequence of the two lug surface sections (in the direction of axis 106) is inversed with respect to the sequence of the cylindrical and conical head portions 116 and 118 of the plunger.

Each lug 120 includes an upwardly opening depression 126 which defines an inner vertical wall 128 that is generally parallel to the housing axis 106 and faces radially outward therefrom. The depressions 126 are positioned and dimensioned so that the vertical walls 128 are within the housing cavity 102 at all times, that is, regardless of whether the lugs are retracted into the housing end 90 or project outwards therefrom as is illustrated in the right-hand portion of FIG. 1.

Figure 4:
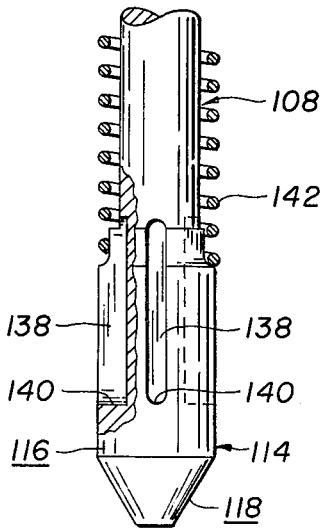
FIG. 4 is a fragmentary side elevational view, partially in section, of the actuating plunger of the present invention and in particular that portion of the plunger which causes the extension and retraction of the insert engaging lugs.

Referring now to FIGS. 1 and 4, a flat, comparatively thin pawl 30 is provided for each lug and it is pivotally disposed within the cavity 102. In the preferred embodiment of the invention the cavity 102 in the enlarged housing end 90 is defined by a curved corner 132 and each pawl 130 has a complementarily curved edge so that the pawl can pivot about the curved corner 132. A first arm 134 on each pawl extends downwardly into the depression 126 in the associated lug 120 and engages the adjacent vertical wall 128. A second, horizontally and inwardly extending arm 136 on each pawl 130 extends into a longitudinal groove 138 in the plunger 108, such groove 138 terminating in a lower end wall 140 so that when the plunger is moved outwards with respect to the housing 74 (in an upward direction as seen in FIG. 1) the end wall 140 will eventually engage the horizontal pawl arm 136 and pivot the pawl so that the downwardly extending arm 134 moves inwardly towards the housing axis 106. This inward motion is transmitted to the vertical wall 128 of the associated lug 120 and is thus employed for retracting said lug into the cavity 102 in the housing 74.

The portion of the actuator rod or plunger 108 which is directly above the actuating head 114 (best seen in FIG. 4) is recessed or of a reduced diameter and receives a helical compression spring 142 the upper end portion of which extends into an enlarged cylindrical well 144 in the lower portion of the housing 74. The well 144 is in communication with the upper portion of the cavity 102, and the lower or inner end of the spring abuts against an annular shoulder at the upper end of the cylindrical head portion 116. The spring is selected so that it biases the plunger downwardly, as seen in FIG. 1, that is, in the direction of conical actuating head portion 118 of the actuating head 114 with a modest force of a few pounds, say 5–10 lbs.

Thus, during non-use of the pickup device 72 the plunger 108 is biased inwardly, that is, into housing cavity 102. This first causes the conical head portion 118 of the actuating head 114 to engage the oblique surface sections 124 of the lugs 120 and, as the inward motion of the plunger under the spring force continues, the conical head portion moves the lugs outwardly through the cutouts 104 until the cylindrical head portion 116 of the actuating head 114 engages the corresponding straight surface sections 122 of the lugs. At that point, illustrated in the right-hand half of FIG. 1, the outer end portions of the lugs extend past the lower end portion of the housing 74 and the cylindrical head portion 116 forms a positive lock against the accidental movement of the lugs back into the housing. The inward movement of the plunger under the spring force terminates when the plunger pull cap 112 at the upper or outer end of the plunger 108 engages the second or outer end 92 of the housing 74.

As long as the plunger 108 is in this position, it is not possible to retract the lugs 120. Conversely, it is not possible to move the plunger inwardly until the pull cap 112 engages the second housing end 92 unless all of the lugs are moved outwardly and their outer ends project past the lower end portion of the housing. This important safety feature of the present invention prevents the engagement of the pickup device with a concrete panel insert 10 without engaging the insert with all of the lugs 120. It further prevents the accidental retraction of one or more of the lugs after the pickup device 72 has been properly inserted into the insert.

The lugs 120 are readily retracted back into the housing by grasping the underside of the pull cap 112, namely, the laterally extending annular reaction surface 146 facing towards the upper or outer end portions of the housing 74, and pulling the plunger outwardly a comparatively small distance against the force of the spring 142. This causes a corresponding movement of the actuating head 114 of the plunger 108 and the longitudinal grooves 138 on the plunger. Once groove end walls 140 engage the horizontal pawl arms 136 the pawls 130 pivot to bring the downwardly extending pawl arms 134 inwardly. This motion is transmitted to the lugs 120 by engagement of the pawls with the vertical lug walls 128 so that the lugs are retracted back within the housing.

Thus, the axial movements of the plunger is translated into corresponding outward and inward movements of the lugs 120. Moreover, the construction is such that an inward movement of the plunger 108 necessarily means that the lugs 120 are moved out of the housing 74 and arrival of the plunger in its rest position (right-hand side of FIG. 1) means that the lugs are locked in their extended position and cannot be retracted.

To enable assembly of the plunger 108 in the housing 74 the enlarged housing end 90 includes in its lower portion an enlarged, axially positioned aperture 148 which has a sufficient diameter so that the actuating head 114 of the plunger can be inserted therethrough. It is preferred that a cap 150 (shown in FIG. 2) be pressed into the aperture 148 after assembly of the plunger and the housing in order to prevent the contamination of the various working parts inside the housing 74.

The operation of the pickup device 72 should now be apparent. In order briefly to summarize it and referring to FIGS. 1, 2, 4 and 6, after the concrete of panel 2 has fully set a pickup device 72 is provided for each insert 10 in the panel. A workman inserts the pickup devices one at a time into their respective inserts 10 by grasping the pull cap 112 of each device and pulling the plunger 108 out of the housing 74 as far as possible (until the spring 142 is fully compressed as shown in the left-hand portion of FIG. 1) in order thereby fully to retract the lugs 120 into the housing. Next, he aligns the housing with the pipe sections 12 of the insert and axially moves the housing into the pipe section. The pull cap 112 is now released so that the spring 142 expands and resultantly moves the plunger 108 downwardly until the pull cap rests against the exposed extremity of the second housing end 92. At that point the outer ends of the lugs 120 project from their corresponding cutouts 104 and engage the lower end 16 of the pipe section 12, such end facing in the direction of the internal concrete cavity 18.

In the event that the housing 74 of the pickup device extends insufficiently far into the pipe section 12 so that the upper, engagement surfaces 152 of the lugs are disposed above (as seen in FIG. 1) the end face 16, the operator or workman backs off the adjustment nut 98 which correspondingly lowers the housing into the pipe section. As soon as the lug engagement surfaces 152 clear the lower end 16 of the pipe section 12 they spring outwardly, thus permitting the plunger 108 and the pull cap 112 to be moved into the housing 74 until the cap engages the upper extremity of the housing end 92. To prevent any loose play the nut 98 can be slightly retightened. For normal use, however, this is not necessary because slight play between the housing 74 and the insert 10 is in fact desirable to prevent any binding between the pickup device 72 and the insert 10 and in particular between the upper lug surfaces 152 and the pipe section end face 16. Such binding can occur in instances in which pickup of the concrete panel with a crane causes the plate 78 of the housing to rotate about the housing axis 106. If the nut 98 is tight an additional slight rotation of the plate may cause a corresponding rotation of the nut on the external screw thread 96 due to frictional engagement between the lug surfaces 152 and the end face 16 of the pipe section 12. Such rotation of the nut 98 can be prevented by placing a layer of a low friction material such as TEFLON between the lower end surface of the nut 98 and the upper end surface 100 of the collar 80.

Alternatively, or in addition thereto, such binding can be prevented by interposing a layer 154 (see FIG. 1) of a crushable material such as plastic between the end face 16 of the pipe section 12 and the lug engagement surfaces 152. In the event of an overtightening of the nut 98 and a rotational movement of the housing plate 78, the movement of the lug surfaces 152 towards the end face 16 crushes the underlying layer 154 of plastic material and prevents the above discussed binding. The maximum axial travel of the housing 74 due to rotation of the plate 78 is never more than that induced by a one-quarter rotation of the plate 78 and the adjustment nut 98 relatively to the housing because rotational movement ends when a clamp or bail 88 faces upwardly. The thickness of the crushable material layer 154 therefore need never be greater than one-half the pitch of the screw thread 96 and from a practical point of view, it need not be greater than one-quarter the pitch. Thus, the earlier discussed mold 32 for forming the internal cavity 18 in the concrete panel 2 and in particular the annular lip 38 thereof need not have a thickness greater than one-half to one-quarter the pitch of screw thread 96.

It should also be pointed out that once the adjustment nut 98 has been properly set there is normally no further adjustment required as long as the pipe section 12 has the proper length.

Figure 5:
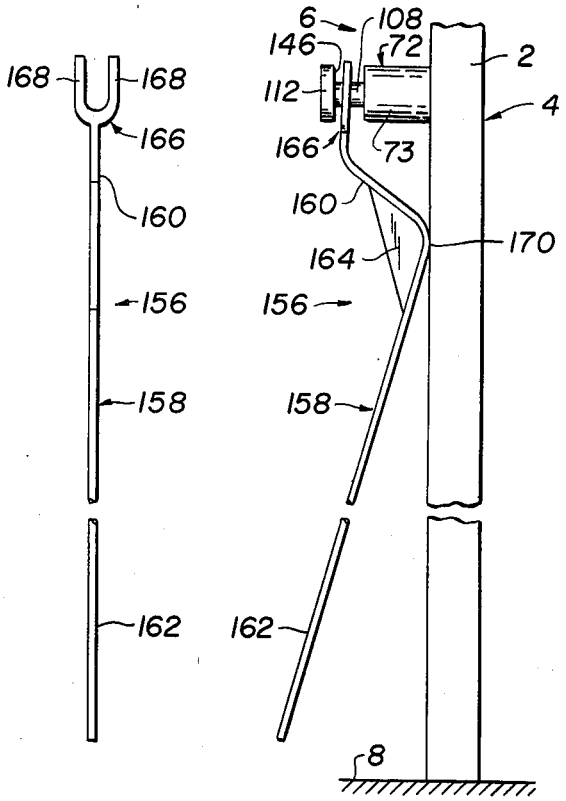
FIG. 5 is of a composite nature and comprises front and side elevational views of the pickup device release tool used with the present invention.

The erected panel 2 remains suspended from the crane until it has been anchored to other panels or members of building 6 and forms an integral self-supporting part thereof. Referring now to FIGS. 1 and 5, the removal of pickup device 72 from the insert is readily accomplished by a workman on the ground 8 without the need for him to climb on a ladder in order manually to pull back the cap 112 of the plunger 108. For this purpose, a release tool 156 is provided which is claimed in combination with other structure in our copending divisional application Ser. No. 851,592, filed Nov. 14, 1977, now U.S. Pat. No. 4,123,882. The tool 156 is in the form of a generally L-shaped handle 158 that has a short leg 160 and a long leg 162 and is of a sufficient length so that a workman can reach the pickup device 72 with the tool. A triangular gusset plate 164 between the connected end portions of the short and long legs stiffens the handle.

The free end of the short leg 160 is bent in the same plane as the remainder of the handle by an angle of less than 90° from the remainder of the short leg and terminates in an upwardly open generally U-shaped fork 166 that is disposed in a plane perpendicular to the plane of the handle parts. The two arms 168 of the fork are spaced apart so that the second or outer end 92 of the the housing 74 and the actuator rod or plunger 108 can be placed therebetween and embraced thereby, with the actuator rod extending transversely through the fork, and the arms can engage the reaction surface 146 of the pull cap 112.

To release the pickup device the workman thus simply aligns the fork of the tool 156 with the housing 74 and then pushes the handle upwardly until the housing end 92 rests in the bottom of the fork. Thereafter, the workman moves the handle towards the panel 2 until the bent handle portion 170 between the short and long legs 160 and 162 rests against the panel. Using the bent handle portion 170 as a fulcrum point the workman pushes the lower handle end (long leg 162) towards the panel, thereby pushing the fork against the reaction surface 146 of the pull cap 112 and moving the pull cap and the plunger 108 attached a short distance away from the housing. This causes a corresponding retraction of the lugs 120 into the housing interior as earlier discussed. Continued movement of the lower handle portion towards the concrete panel 2 now axially moves the housing assembly 73 out of the insert 10 until the housing assembly clears the panel and hangs from the crane. The latter may now be operated to lower the pickup device for use in connection with the next panel to be erected.

It should be noted that the whole pickup device release operation can be performed by a single workman on the ground with an exceedingly simple tool. The release is both rapid and safe since the whole pickup device remains suspended from the crane at all times. In addition, the release of the pickup device does not separate any part from it; in other words, the pickup device remains an assembled unit at all times and neither its release from nor its attachment to the insert requires that a separate part be added or removed. This is a most significant safety feature not normally available with prior art pickup systems.

Figure 3:
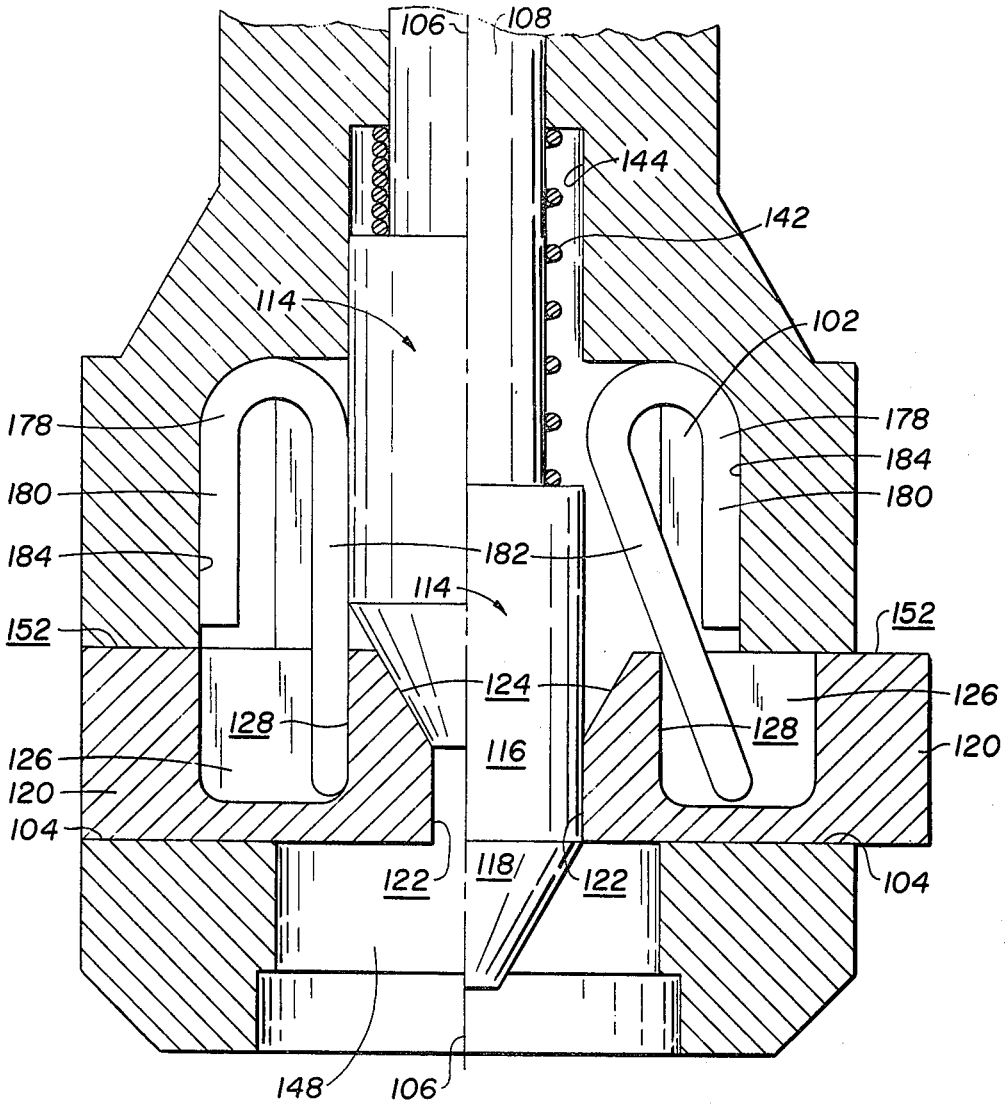
FIG. 3 is a side view, similar to FIG. 2, but illustrating another embodiment of the invention.
Figure 7:
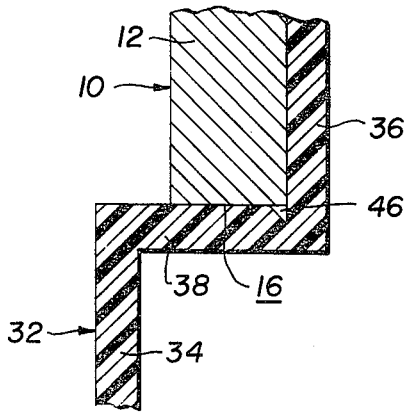
FIG. 7 is an enlarged, fragmentary sectional view showing in detail the weakened connection which is disposed between the outer and inner mold sections and serves to permit removal of the outer mold section through the tubular insert after pouring and hardening of the panel-forming concrete around the insert.

Referring now to FIGS. 2 and 3 of the drawings, they illustrate variations in the construction of the means for returning the lugs 120 into the housing 74 upon moving plunger 108 outwards in its bore as above described. For simplicity, FIGS. 2 and 3 employ the same reference numerals except for the parts that differ from those the pickup device 72 as shown in FIG. 1.

Referring now to FIG. 2, the pawls 172 for retracting the associated lugs 120 have a slightly different configuration from the pawls 130 as shown in FIG. 1. The pawls which are shown in FIG. 2 have an inverted L-shaped configuration and each comprises a downwardly extending arm 174 and a generally horizontally oriented arm 176. The latter is disposed in a longitudinally extending plunger groove 138 and is engaged by the lower end wall 140 of the groove so that when the plunger 108 is moved partially out of the housing 74, the pawl 172 thereby pulls the corresponding lug 120 inwardly into the housing. From the standpoint of operation, the pawls operate in the same manner as the pawls 130 shown in FIG. 1.

FIG. 3 shows a slightly different arrangement from FIG. 2 in that no pawls are provided for retracting the lugs 120. Instead, generally U-shaped springs 178 having each a short leg 180 and a long leg 182, are positioned in the housing cavity 102. Both legs of each spring are generally parallel to the housing axis 106 with the short leg 180 resting against an outer vertically extending cavity wall 184 and the long leg 182 resting or abutting partly against the plunger actuating head 114 and partly against the outwardly facing wall 128 of the lug depression 126. The springs 178 are constructed so that when the legs thereof are parallel they are tensioned and the legs are biased away from each other.

In use, when the plunger is fully inserted into the housing and the outer ends of the lugs 120 project from cutouts 104 to the housing exterior (right-hand side of FIG. 3) the springs 178 are deformed so that the spring legs converge. When an operator pulls on the pull cap 112 (not shown in FIG. 3) and the plunger is raised, as seen in the left-hand side of FIG. 3, the long spring legs 182 continuously bias the lugs inwardly. As the oblique surface sections 124 of the lugs 120 engage the conical head portion 118 the biasing force of the springs moves the lugs inwardly until they are fully retracted as above discussed. Thus, unlike the pawls 130 or 172 which mechanically translate a plunger movement out of the housing into a corresponding lug movement into the housing, in the embodiment shown in FIG. 3 there is no such direction connection. Instead, the lugs 120 are moved inwardly by the springs 178. Accordingly, in the embodiment of the invention shown in FIG. 3 the grooves 138 in the plunger are eliminated. In all other operational respects, however, the embodiment of FIG. 3 functions as above described.

Referring again to FIG. 9 of the drawings, the insert 58 has a rounded corner 59 which connects the underside 70 and an upstanding side 61. In order securely to connect the pickup device 72 to the insert 58 the device, when used with an insert having such a rounded corner 59, is fitted with lugs 186 which have a cylindrical cross-section and semi-spherical outer ends 188 of a radius complementary to that of the rounded corner 59. Means may further be provided (not separately shown) to prevent rotation of the cylindrical lugs in the housing 74. In all other respects, the lugs 186 are constructed and mounted and operate in the same manner as the lugs 120 shown in FIG. 1, 2 or 3. To facilitate an understanding of FIG. 9 the pickup device (fragmentarily) illustrated in FIG. 9 has been given the same reference numerals as the pickup device shown in FIG. 1.

The insert 58 of FIG. 9 is further provided with a bottom closure 190 which, together with the insert 58, forms the concrete cavity 18 and shields the cavity from contamination by concrete or other foreign objects.

We claim:

1. Apparatus for the releasable connection to a tubular member embedded in an object, the member defining an opening in the object and including an inwardly facing shoulder disposed interiorly of the opening, the apparatus comprising:

plate means adapted to be placed across the opening and including an aperture for alignment with the opening;

an elongated housing extending through the aperture and having an axial bore, the inner end of the housing being adapted for positioning in said opening, and including a laterally extending cutout, a locking lug carried by the housing for lateral movement within the cutout from a first position in which the lug is out of engagement with the shoulder to a second position in which a portion of the lug protrudes laterally from the housing into engagement with the shoulder;

actuating means comprising an elongated plunger slidably disposed in the bore for moving the lug between the first and second positions responsive to movement of the actuating means longitudinally in the bore between corresponding first and second positions;

the actuating means including means for positively and mechanically locking the lug in its second position when the actuating means is in its second position; and a pivoted pawl disposed interiorly of the housing, the pawl having means engaging the lug and means engaging the plunger during plunger movement from its second position to its first position so that such plunger movement is translated into corresponding movement of the lug from its second position to its first position.

2. Apparatus according to claim 1 and wherein said plunger includes an actuator head positioned proximate the lug, the actuator head including a lead cone and the lug including a complementary tapered surface for engagement by the lead cone and movement of the lug from the first to the second position when the plunger is moved from its first to its second position; said locking means comprises a cylindrical portion on the actuator head axially contiguous to the lead cone; and said lug has a surface that is complementary to the cylindrical portion for engagement thereby when the plunger is in its second position thereby to maintain the lug locked in its second position until the plunger is moved into its first position.

3. A pickup device for a concrete panel having a tubular insert defining a generally cylindrical opening and an inwardly facing shoulder positioned inwardly of the opening, the pickup device comprising:

a generally cylindrical housing assembly dimensioned to extend snugly into the opening, said assembly including a housing having first and second ends and an internal cavity at the first end, an elongated bore extending from the cavity to the second end, and a plurality of cutouts extending generally radially outward of the cavity in directions perpendicular to the bore;

a plunger slidably disposed in the bore and having a first end disposed within the cavity and a second end protruding past the second end of the housing, the first plunger end being defined by a generally conical portion and a contiguous, generally cylindrical portion;

a lug disposed in each cutout and dimensioned so that it can be translated between a first position in which it is disposed wholly within the housing and a second position in which a portion of it protrudes beyond the housing into engagement with the inwardly facing shoulder when the device is disposed within the insert, a side of each lug facing the axis of the plunger including a first surface section that is generally parallel to the axis of the plunger and a second surface section that extends generally in the same direction as the conical plunger portion, the second and the first surface sections being arranged to be engaged sequentially by the conical plunger portion and the cylindrical plunger portion, respectively, when the plunger is axially moved in the direction in which the conical portion faces, correspondingly to move each lug in a direction perpendicular to the plunger axis outwardly of the cavity and its cutout, and then to positively and mechanically lock each lug in its extended position until the plunger is moved in a direction opposite to the direction in which the conical portion faces, and pawl means pivotally disposed within the cavity and in simultaneous engagement with the plunger and the lugs for translating movement of the plunger in said opposite direction into corresponding movement of each lug towards the cavity, for moving each lug from its second position to its first position.

4. A concrete panel pickup device for insertion into an opening in the panel, the device comprising:

lifting means attached to a plate for placement of the plate across the opening and against the panel;

a hollow housing axially movably attached to the plate;

a plurality of generally radially movable lugs disposed within an end of the housing inserted into the opening, for use in connection with pickup of the panel, the lugs being dimensioned and positioned so that they can be fully retracted into the housing interior;

actuating means movably disposed within the housing and projecting therefrom at an end of the housing opposite to the first-mentioned end;

the actuating means including first means for translating actuating motion of the actuating means into a corresponding motion of the lugs in a radially outward direction until the lugs extend past the exterior of the housing, and second means for positively and mechanically locking the lugs in their extended position and preventing their return to their retracted position; and pawl means pivotally disposed within the first-mentioned end of the housing and in simultaneous engagement with the actuating means and the lugs for translating a further motion of the actuating means into corresponding motion of the lugs in a radially inward direction until the lugs are fully retracted into the housing interior.

5. A pickup device for lifting a concrete panel and erecting it upright comprising in combination:

(a) an elongated, generally cylindrical housing having a first end defining an enlarged housing portion including an internal cavity, a second end, a bore communicating the cavity with the second end, and a plurality of radially oriented cutouts disposed in a common plane and communicating the cavity with the exterior of the housing;

(b) a plate engaging the housing exterior and disposed between the enlarged portion and the second end of the housing, the plate being axially movable with respect to the housing and having a lifting bail attached thereto, the plate being disposed perpendicular to the housing axis and having a collar depending from the plate towards the enlarged housing portion, the collar having a diameter substantially equal to the enlarged housing portion diameter;

(c) a lug slidably disposed in each cutout, each lug being dimensioned to be wholly disposed interiorly of the housing and to be moved along the cutout in a radial direction to protrude from the housing, a side of each lug facing the axis of the housing having first and second contiguous surface sections which are, respectively, parallel to the housing axis and inclined thereto, the second surface section facing the second housing end, and each lug having a wall facing generally radially outwardly and disposed interiorly of the cavity;

(d) an elongated plunger axially movably disposed in the housing bore, having a first end disposed within the cavity, and having a second end extending from the cavity past the second housing end, the first end of the plunger having first and second surfaces which are, respectively, generally parallel to the first and second surface sections of the lugs, the second surface of the plunger being angularly inclined with respect to the plunger axis and facing away from the second housing end, the second and first lug surface sections being arranged so as to be sequentially engaged by the second and first plunger surfaces respectively in order thereby to move the lugs radially outwardly into their extended position and positively and mechanically lock the lugs in their extended position when the plunger is moved in the direction in which its second surface faces, and the plunger having axially oriented grooves bordered by shoulders disposed generally perpendicular to the plunger axis and facing towards the second end of the housing;

(e) spring means biasing the plunger towards the housing cavity and into engagement with the lugs;

(f) means secured to the plunger for limiting spring means-induced plunger travel and for applying to the plunger a force directed opposite to the spring means-exerted force for movement of the plunger in the opposite direction against the force exerted by the spring means; and (g) a pawl for each lug pivotally movably disposed in the cavity, the pawls engaging the outwardly facing walls of their respective lugs, portions of the pawls being disposed in the plunger grooves and positioned to be engaged by the shoulders in order that the pawls serve to retract the lugs inwardly into the cavity in response to movement of the plunger in the opposite direction.

6. A device according to claim 5 and wherein a portion of each lug extending past the housing has a planar engagement surface that is perpendicular to the axis of the bore and faces towards the second housing end.

7. A device according to claim 6 and wherein each lug has a generally rectangular cross-section.

8. A device according to claim 6 in combination with an anchor insert installed in a hole in the concrete panel, the insert comprising a tubular member having a lesser length than the depth of the hole and an interior diameter complementary to the exterior diameter of the enlarged housing portion and of the collar so that the collar and the enlarged housing portion can be slidably placed in the insert, whereby an end of the tubular member disposed interiorly of the panel provides a recessed shoulder that faces the interior of the hole, the shoulder being dimensioned so that when the housing extends into the insert with the lugs in their extended position, the engagement surfaces of the lugs engage the shoulder thereby to engage the pickup device with the insert until the lugs are retracted.

9. A pickup device according to claim 5 and wherein a portion of the housing exterior adjacent to the second end includes an external screw thread, and a nut engages the thread, has an end face facing the plate, and serves to limit the plate to movement on a housing segment between the enlarged portion and the nut.

10. A pickup device according to claim 9 and including a low friction material layer disposed between the nut end face and a part of the plate.

11. A pickup device according to claim 8 and including a relatively thin layer of a crushable material disposed between the shoulder of the tubular member and the lug engagement surfaces.

12. A pickup device according to claim 11 and wherein the crushable layer comprises a plastic material.

13. A pickup device according to claim 11 and wherein the crushable layer has a thickness of no more than about one-half of the pitch of the external screw thread.

14. A pickup device according to claim 12 and wherein the crushable layer has a thickness of no more than about one-quarter of the pitch of the external screw thread.

15. A pickup device according to claim 8 and including a cup constructed of a thin walled material, embedded in the panel and defining the portion of the hole extending past the tubular member.

16. A device according to claim 15 and wherein the cup has a generally cylindrical configuration and an inner diameter larger than an inner diameter of the tubular member.

17. A device according to claim 16 and wherein the cup includes an annular lip that protrudes inwardly from a cylindrical wall of the cup, and lip being in abutment with the shoulder of the tubular member.

18. A device according to claim 17 and wherein the cup is constructed of a plastic material.

19. A device according to claim 5 and wherein a portion of each lug extending past the housing terminates in a generally semi-spherical end.

20. A device according to claim 19 and wherein each lug has a generally cylindrical cross-section.

21. An insert for placement in a concrete panel poured in a horizontal position to enable the erection of the panel with a panel pickup device releasably secured to the insert, the insert comprising a generally tubular central member defining an opening through which the pickup device can be extended in use, an inner end face, and an outer end face, the opening having a smooth, uninterrupted, cylindrical interior wall, a plurality of legs having free ends which are spaced from the outer end face of the member a distance substantially equal to the thickness of the panel to be poured, means securing the legs to the member, and a relatively thin layer of a readily crushable material in abutment with the inner end face of the tubular member.

22. An insert for placement in a concrete panel poured in its horizontal position to enable the erection of the panel with a panel pickup device releasably secured to the insert, the insert comprising a generally tubular central member defining an opening through which the pickup device can be extended in use, an inner end face, and an outer end face, the opening having a smooth, uninterrupted, cylindrical interior wall, a plurality of legs having free ends which are spaced from the outer end face of the member a distance substantially equal to the thickness of the panel to be poured, means securing the legs to the member, a concrete cavity plastic mold for the formation in the panel of a cavity which extends from the inner end face into the interior of the panel, the mold being defined by a relatively thin walled first tubular section disposed within the interior of the cylindrical surface of the tubular member, a second tubular section having a diameter greater than the first section, an annular tip interconnecting the adjacent ends of the first and second tubular sections proximate and abutting against the inner end face of the member, an end wall interconnecting another end of the second tubular section in order thereby to form a cavity within the sections which is closed towards the interior of the panel, means enabling the separation of the first section from the second section after the panel has been poured, said means for separating comprising means for separating the first tubular section from the lip so that the lip remains with the concrete panel after removal of the first section.

23. An insert according to claim 22 and wherein the separating means comprises a reduced cross-section in the lip aligned with an outer cylindrical wall of the first tubular section.

24. An insert for placement in a concrete panel poured in its horizontal position to enable the erection of the panel with a panel pickup device releasably secured to the insert, the insert comprising: a relatively short section of standard pipe having a smooth interior cylindrical surface and spaced apart, generally parallel inner and outer end faces, a plurality of generally L-shaped anchoring legs having first leg sections parallel to the pipe section and welded to an external surface of said pipe section, and second leg sections extending generally radially outward of the first leg sections, spacing the second leg sections from the outer end face of the pipe section a distance which is substantially equal to the thickness of the panel, and a relatively thin annular layer of a relatively crushable material applied to the inner end face of the pipe section.

25. An insert according to claim 24 and wherein the crushable material comprises a layer of a plastic material.

* * * * *